US008181906B2

(12) United States Patent
Koessler et al.

(10) Patent No.: US 8,181,906 B2
(45) Date of Patent: May 22, 2012

(54) METHOD AND APPARATUS FOR RAM DECELERATION IN A LAUNCH SYSTEM

(75) Inventors: Jeffrey H. Koessler, Tucson, AZ (US); Brian L. Cochran, Tucson, AZ (US); Mark A. DeBake, Casa Grande, AZ (US); Steven J. Elder, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 485 days.

(21) Appl. No.: 12/417,418

(22) Filed: Apr. 2, 2009

(65) Prior Publication Data

US 2010/0252676 A1 Oct. 7, 2010

(51) Int. Cl.
*B64F 1/04* (2006.01)

(52) U.S. Cl. ..... 244/63; 89/1.818

(58) Field of Classification Search ..... 244/63, 244/49, 138 A, 116, 3.1, 54, 135 R, 173.1, 244/2, 190, 123.5; 29/850; 102/202, 520, 102/521, 522, 523; 89/1.817, 1.8, 1.57, 1.814, 89/1.818; 228/102; 606/181
See application file for complete search history.

(56) References Cited

U.S. PATENT DOCUMENTS

| | | | | | |
|---|---|---|---|---|---|
| 2,654,320 | A | * | 10/1953 | Schmid | 244/138 A |
| 2,832,632 | A | * | 4/1958 | Johnson | 294/82.26 |
| 3,041,017 | A | * | 6/1962 | Sieve et al. | 244/63 |
| 3,459,100 | A | * | 8/1969 | Pfister | 89/1.8 |
| 3,828,656 | A | | 8/1974 | Biddle et al. | |
| 4,046,076 | A | * | 9/1977 | Hampton | 102/202 |
| 4,388,853 | A | * | 6/1983 | Griffin et al. | 89/1.57 |
| 4,678,143 | A | * | 7/1987 | Griffin | 244/63 |
| 5,126,524 | A | | 6/1992 | Moro et al. | |
| 5,310,134 | A | | 5/1994 | Hsu et al. | |
| 5,695,153 | A | * | 12/1997 | Britton et al. | 244/63 |
| 5,779,190 | A | * | 7/1998 | Rambo et al. | 244/54 |
| 5,850,989 | A | * | 12/1998 | Trudeau et al. | 244/63 |
| 5,918,307 | A | | 6/1999 | Cipolla | |
| 5,942,712 | A | | 8/1999 | Mello | |

(Continued)

FOREIGN PATENT DOCUMENTS

WO WO-2011002479 A1 1/2011

OTHER PUBLICATIONS

"International Application Serial No. PCT/US2010/00966, Search Report mailed Dec. 9, 2010", 3 pgs.

(Continued)

*Primary Examiner* — Joshua J Michener
*Assistant Examiner* — Medhat Badawi
(74) *Attorney, Agent, or Firm* — Schwegman, Lundberg & Woessner, P.A.

(57) ABSTRACT

One embodiment includes a launch vessel defining an elongate, linear interior extending from a bottom portion to an exit opening. The embodiment includes a ram slidably disposed in the launch vessel, the ram sealed to the vessel. The embodiment also includes one or more wedges coupled to the launch vessel along the interior proximal the exit opening, with each wedge shape sized to increasingly narrow a cross section of the interior along an exit vector extending from the bottom portion toward the exit opening. In the embodiment, the vessel is to house a charge proximal the bottom portion, the charge to propel the ram along the exit vector, with the one or more wedges sized to stop be ram inside the interior.

10 Claims, 7 Drawing Sheets

U.S. PATENT DOCUMENTS

| | | | | |
|---|---|---|---|---|
| 6,418,870 | B1 | 7/2002 | Lanowy et al. | |
| 6,427,599 | B1 | 8/2002 | Posson et al. | |
| 2003/0116677 | A1* | 6/2003 | Young et al. | 244/63 |
| 2003/0155463 | A1* | 8/2003 | Cox et al. | 244/3.1 |
| 2003/0226771 | A1 | 12/2003 | Coboy et al. | |
| 2004/0260324 | A1* | 12/2004 | Fukuzawa et al. | 606/181 |
| 2005/0274845 | A1* | 12/2005 | Miller et al. | 244/49 |
| 2006/0107828 | A1* | 5/2006 | Veitch et al. | 89/1.809 |
| 2006/0143909 | A1* | 7/2006 | Miczek et al. | 29/850 |
| 2006/0249623 | A1* | 11/2006 | Steele | 244/116 |
| 2006/0254570 | A1* | 11/2006 | Dillon, Jr. | 124/69 |
| 2008/0035705 | A1* | 2/2008 | Menotti | 228/102 |
| 2008/0041221 | A1* | 2/2008 | Gaigler | 89/1.806 |
| 2008/0078886 | A1* | 4/2008 | Foster et al. | 244/173.1 |
| 2008/0093501 | A1 | 4/2008 | Miller et al. | |
| 2008/0148927 | A1* | 6/2008 | Alberding et al. | 89/1.817 |
| 2009/0007895 | A1* | 1/2009 | Kenworthy | 124/62 |
| 2009/0041078 | A1* | 2/2009 | Yuhas | 374/7 |
| 2009/0152391 | A1* | 6/2009 | McWhirk | 244/30 |
| 2010/0013226 | A1* | 1/2010 | Blumer et al. | 290/44 |
| 2010/0123041 | A1* | 5/2010 | Nair et al. | 244/63 |
| 2010/0193626 | A1* | 8/2010 | Goossen et al. | 244/2 |
| 2010/0246797 | A1* | 9/2010 | Chavez et al. | 379/265.02 |
| 2011/0006166 | A1* | 1/2011 | Arlton et al. | 244/7 A |
| 2011/0180667 | A1* | 7/2011 | O'Brien et al. | 244/135 R |
| 2011/0204187 | A1* | 8/2011 | Spirov et al. | 244/190 |

OTHER PUBLICATIONS

"International Application Serial No. PCT/US2010/00966, Written Opinion mailed Dec. 9, 2010", 8 pgs.

"International Application Serial No. PCT/US2010/000966, International Preliminary Report on Patentability mailed Oct. 13, 2011", 8 pgs.

* cited by examiner

METHOD AND APPARATUS FOR RAM DECELERATION IN A LAUNCH SYSTEM

LICENSE RIGHTS

This invention was made with United States Government support under Contract number NBCHC040160 with the Department of the Interior. The United States Government has certain rights in this invention.

BACKGROUND

During a launch, launch systems can damage their payloads or items associated with the payloads, such as cords or tethers that couple the payload to another device, such as a controller. For example, electrical portions of a projectile may be subjected to an unacceptable level of vibratory shock during launch. This vibratory shock can dislodge electrical components or otherwise damage them. In another example, a tether that is connected to the payload can be damaged during launch. Better control of launch apparatus, systems and methods is needed to reduce instances of damage to projectiles that are launched and to reduce instances of damage to devices associated with those projectiles, such as tethers.

SUMMARY

One embodiment of the present subject matter includes a lightweight launch system for launching an unmanned aerial vehicle ("UAV"). The system includes a carbon fiber cylinder of a length extending from a distal portion terminating at an exit opening to a proximal portion terminating at a closed bottom portion. The system also includes a carbon fiber ram sealably disposed in the carbon fiber cylinder, the ram including a plurality of protrusions to maintain the UAV in alignment with the ram while the ram traverses the length of the cylinder, the ram at least partially defining an aperture. The system also includes a cable disposed through the aperture and coupled to the UAV and to electronics disposed outside the cylinder. The system further includes a propellant disposed between the closed bottom portion and the ram, the propellant to force the ram and the UAV out of the cylinder. The system also includes four wedges coupled to the exit opening along an interior of the cylinder, the four wedges to define a modified interior of the vessel at the exit opening that has a reduced interior boundary that is less than a cross section at the closed bottom portion. In, the four wedges are located a distance along the length of the cylinder to maintain slack in the cable from the ram to the closed bottom portion of the vessel after the ram is wedged between at least two of the wedges. Also, the system includes at least one step-shaped stop extending into the interior of the cylinder, the step shape stop further away from the closed bottom portion than the four wedges, the step-shaped stop defining a further modified interior that has a further reduced interior boundary that is less than the cross section. Embodiments are included in which the system is formed of components of a mass less than a specified mass for carry by a single soldier.

DETAILED DESCRIPTION

The following description and the drawings sufficiently illustrate specific embodiments to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in, or substituted for, those of other embodiments. Embodiments set forth in the claims encompass all available equivalents of those claims.

Figure 1B:
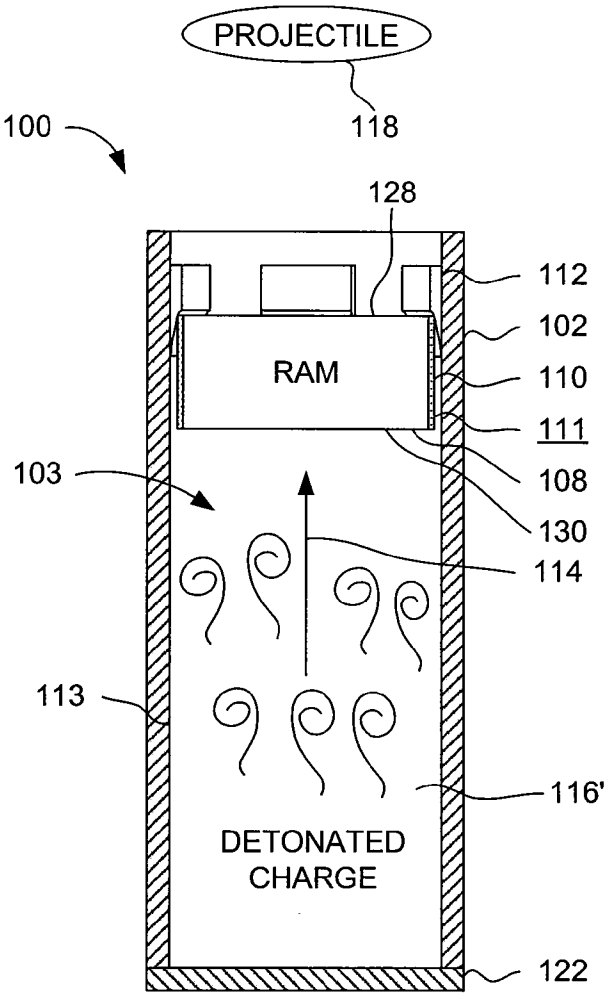
FIG. 1B is the diagram of the system of FIG. 1A in a second mode of operation.
Figure 1A:
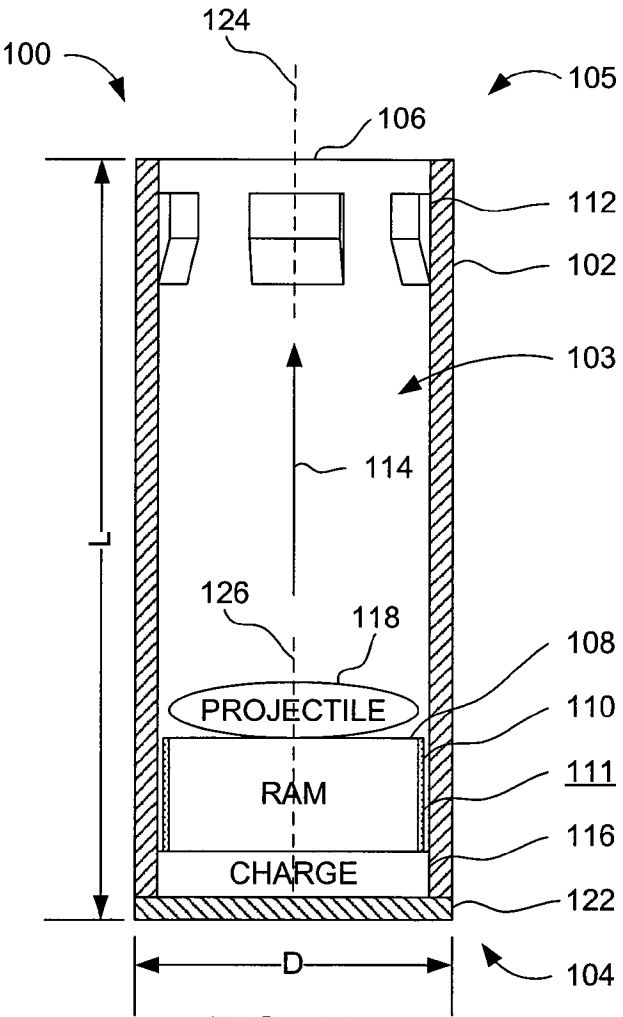
FIG. 1A is a partial cross section of a launch system, according to some embodiments.

FIG. 1A is a partial cross section of a launch system 100, according to some embodiments. FIG. 1B is a diagram of the system of FIG. 1A in a second mode of operation. The system 100 is to launch a projectile 118. A charge 116 is to propel a piston or ram 108 along an exit vector 114 through the launch vessel 102 and toward a distal portion 105. The vessel terminates in an exit opening 106 through which the projectile 118 is free to travel.

In some embodiments the charge 116 includes an propellant to expand against the ram 108 to force the ram 108 along exit vector 114 and toward the exit opening 106. In some embodiments, the charge 116 includes a gas generator. Some examples include a gas generator such as that used in an automotive airbag. In some embodiments, the gas generator is to blow the ram toward the exit opening 106. The present subject matter includes other kinds of charges to propel the ram 108. For example, some embodiments move the ram 108 by pressurizing gas under the ram 108. In various embodiments, the projectile 118 rests on the ram 108 and departs from the ram 108 and a vessel 102 when the ram 108 encounters one or more ramps or wedges 112 (112 is typical of a plurality) and is slowed or stopped by those one or more wedges 112.

The one or more wedges 112 are coupled to vessel 102 along the vessel interior 103. In various embodiments, the one or more wedges 112 are disposed around the exit opening 106. In various embodiments, the one or more wedges 112 are to wedge the ram 108 in the launch system 100.

The projectile 118 is an ordinance in some embodiments. In some embodiments, the projectile 118 is an unmanned aerial vehicle ("UAV"), but the present subject matter is not so limited. In some embodiments, the launch system 100 is a reusable single-man carryable UAV launching system. In various embodiments, the launch system is formed of components of a mass less than a specified mass for carry by a single soldier, according to a specified specification, such as a military specification.

In some UAV embodiments, the UAV remains connected to terrestrial control electronics via a cord, cable or tether that is disposed at least partially within the launch vessel 102. In some embodiments a fiber optic cable is coupled between a projectile and the launch system 100. In additional embodiments, the UAV remains connected to terrestrial control electronics via a cable, cord or tether that is disposed outside the launch vessel 102. An example cable 302 is illustrated at least partially within a launch vessel 102 in FIG. 3D. The present subject matter is to launch a projectile 118 such as a UAV while reducing the probability of damage to a cable during and after launch, according to various embodiments disclosed herein.

Embodiments disclosed herein provide one or more structures to slow and stop the travel of the ram 108 as the ram 108 moves along exit vector 114 toward the exit opening 106. Launch system 100 slows the ram 108 as it move along an exit vector 114 toward the exit opening 106 before stopping it. The launch system 100 allows the ram 108 to travel freely before stopping it, imparting less stress onto components that touch the ram 108, such as electronics or a cable, cord or tether. In one example, a cable, cord or tether extends through the ram 108 during the launch, and the cable experiences a lower shock from the ram 108 slowing prior to stop than it does in embodiments in which the travel of ram 108 is freely allowed prior to the ram 108 stopping.

The launch system 100 more reliably maintains the orientation of the ram 108 with respect to the launch vessel 102. If the ram 108 is allowed to move freely along an exit vector 114 before it stops near the exit opening 106, the shock from stopping can be great. This stopping shock can cause the ram 108 to change its orientation in the launch vessel 102. In some instances, the ram 108 rotates around a diameter of the ram 108.

Rotation of the ram 108 around a diameter of the ram 108 is problematic. In embodiments with a cable, cord or tether disposed through the ram 108, such rotation can be damaging to the cord. Such rotations can also damage the launch vessel 102. This is troublesome, as users often want to reuse the launch system 100 to launch multiple projectiles.

Figure 3A:
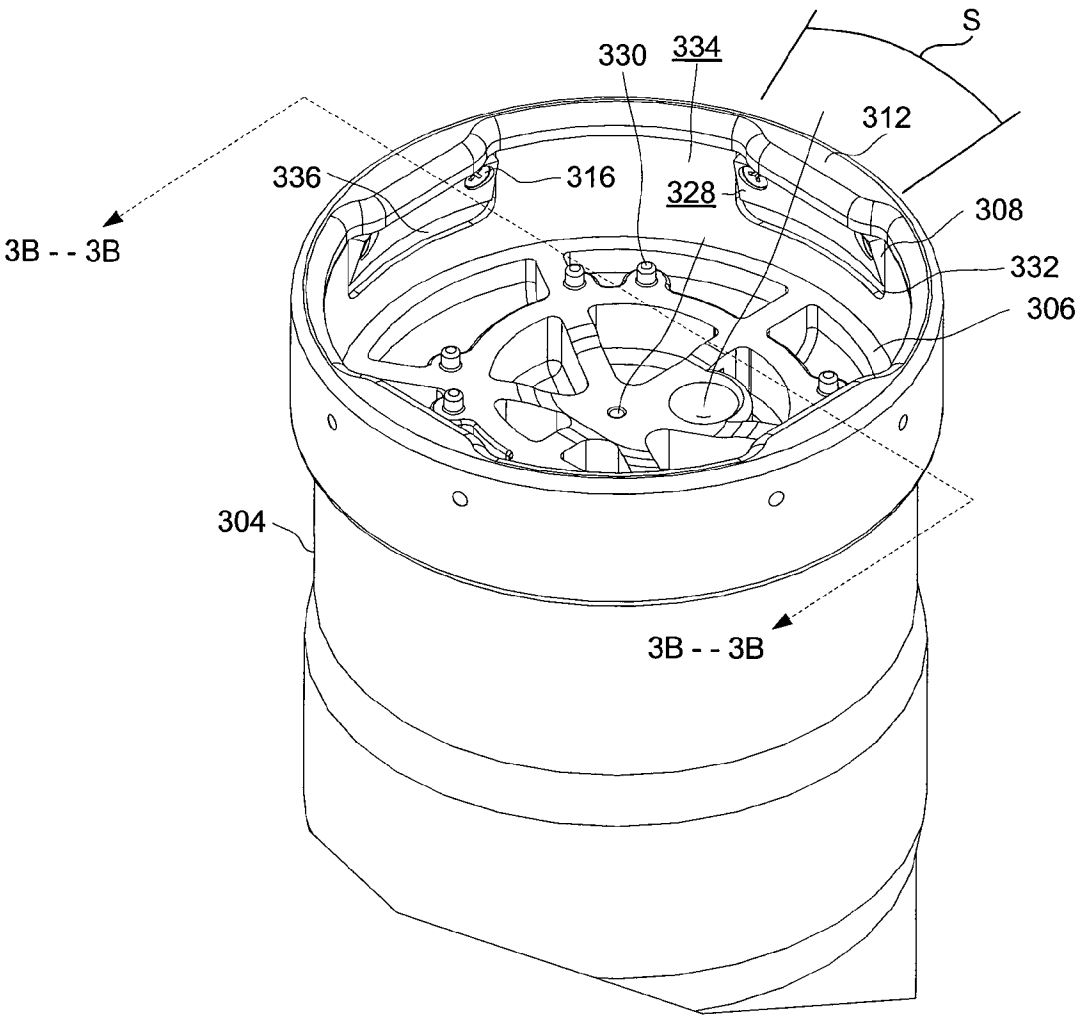
FIG. 3A is a perspective view of an exit opening, according to some embodiments.

Embodiments that do not use one or more wedges 112, but that want to prevent the ram 108 from exiting the launch vessel 102 during launch, use some other structure to decelerate the ram 108, such as a lip 312 extending into the exit opening 106. FIG. 3A illustrates an example lip 312. When the ram 108 hits a lip, a great shock can be experienced and can damage one or a combination of the ram 108, the lip 312 and the launch vessel 102. Using the one or more wedges 112 to decelerate the ram 108 before stopping the ram 108 reduces instances of damage by reducing the magnitude and/or duration of the shock those components experience due to deceleration of the ram 108. This design can allow for a ram 108 of a reduced thickness, as the thickness is not constrained by whether the ram 108 is thick enough to resist spinning around a diameter of the ram 108 upon stopping movement along an exit vector 114 of the ram 108.

The launch vessel 102 is alternatively known as a barrel or tube. The illustrated vessel 102 is cylindrical, but the present subject matter includes embodiments which are another shape. Some cylindrical embodiments have a uniform diameter along their length L, but examples that are not cylindrical are also possible. Non-cylindrical embodiments include rectangular ones and those defining a frustoconical-shaped interior 103. The embodiments illustrated in FIGS. 1A and 1B have a length L that is greater than the diameter D, although other aspect ratios are possible. The vessel interior 103 extends from a bottom portion 104 to an exit opening 106.

The ram 108 is slidably disposed in the launch vessel 102. The ram 108 is shaped to conform to the vessel interior 103 in that the ram 108 has an edge face 111 that confronts an interior face 113 of the vessel 102. In some embodiments this face is linear, and in others it is curvilinear. This confrontation can include an abutting relationship. In an abutting relationship, the edge face 111 is held within a specified tolerance, the interior face 113 is held within a respective specified tolerance, and the space between the edge face 111 and the interior face 113 is selected to allow for slidable disposition of the ram 108 in the vessel 102 with the ram maintaining alignment with the vessel throughout a travel path through the vessel 102 such that a center axis 126 of the ram 108 remains parallel with a center axis 124 of the vessel 102.

In various embodiments, the ram 108 is sealably, slidably disposed in the launch vessel 102. For example, in some embodiments, the ram 108 conforms to the vessel interior 103 such that gas flow from the bottom side 130 of the ram 108 to the top side 128 is restricted during launch of the projectile 118. In some embodiments, a seal 110 is provided to seal the ram 108 to the vessel 102 so that the ram 108 is sealably disposed in the launch vessel 102. The seal 110 can include, but it not limited to, bushings, O-rings, ram rings, and other types of seals used to seal rams.

Various embodiments include one or more wedges 112 coupled to the launch vessel 102. The one or more wedges 112 are coupled using one or more of adhesive, fasteners, welding or another coupling. In some embodiments, the adhesive is blue yellow adhesive. In various embodiments, the one or more wedges 112 are coupled to the launch vessel 102 along the vessel interior 103 proximal the exit opening 106. In various embodiments, the one or more wedges 112 are sized and/or oriented with respect to the launch vessel 102 to increasingly narrow a cross section, such as that pictured in FIGS. 1A-B, of the vessel interior 103 along an exit vector 114 extending from the bottom portion 104 toward the exit opening 106. Some embodiments include a launch vessel 102 that is a stopped cylinder. Some stopped cylinder embodiments include an endcap 122. Cylinders that are open and not stopped are also possible.

In various embodiments, the launch vessel 102 is to house a charge 116. In various embodiments, the charge 116 is housed proximal the bottom portion 104. The charge 116 is to propel the ram 108 along the exit vector 114, with the one or more wedges 112 sized to stop the ram 108 inside the vessel interior 103. In various embodiments, the charge 116 generates gas to blow the ram 108 toward the exit opening 106. FIG. 1B illustrates a detonated charge 116'. In additional embodiments, the charge 116 is an explosive charge to expand gas to propel the ram 108 along the exit vector 114. In embodiments which do not include an endcap 122, the charge mass should be sized so that detonation of the charge 116 can move the ram 108 toward the exit opening 106 with sufficient force.

Figure 2:
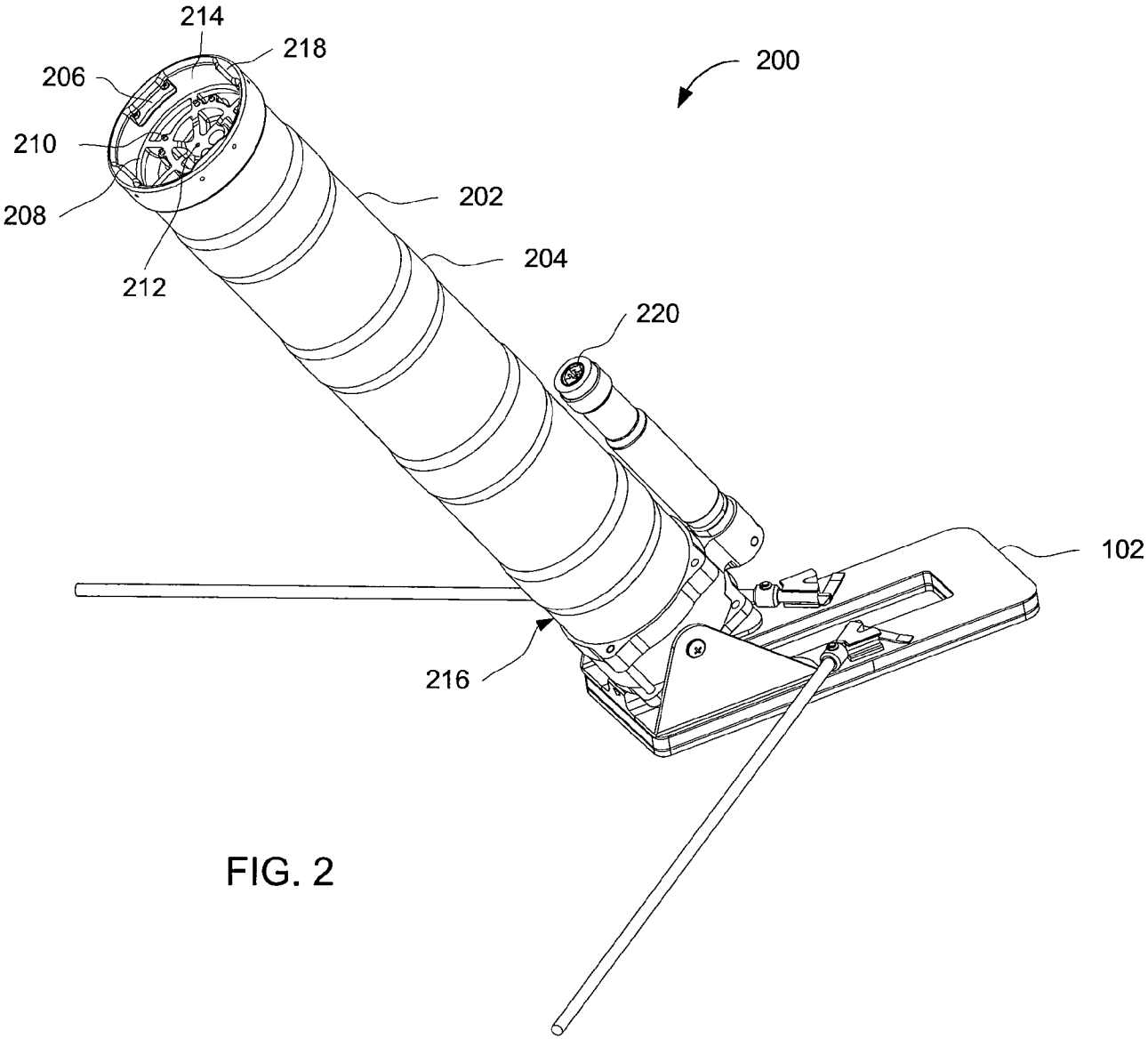
FIG. 2 is a perspective view of a deployed launch system, according to one embodiment.

FIG. 2 is a perspective view of a deployed launch system 200, according to one embodiment. The launch system 200 includes a launch vessel 202. In various embodiments, the launch vessel 202 is cylindrical, but the present subject matter is not so limited. In various embodiments, one or more reinforcement ribs 204 are coupled to the launch vessel 202 to increase the hoop strength of the launch vessel 202. The ribs 204 are optional. In various embodiments, the ribs 204 are fixed to the vessel 202, such as through adhesion. In additional embodiments, the ribs 204 are formed of the same material as the vessel 202 so that the vessel 202 and the ribs 204 are a one-piece, monolithic component. In various embodiments, one or more of the vessel 202 and ribs 204 are carbon fiber, but the present subject matter is not so limited, and other materials are contemplated, such as plastic, steel, aluminum and combinations thereof.

Coupled to launch vessels of the present subject matter are one or more wedges. In some embodiments, four wedges 206 (206 is typical) are coupled to the launch vessel 202. In some embodiments, the wedges 206 are distributed equidistant from one another around a circumference of the launch vessel 202.

Various embodiments include a ram 208, optionally formed of carbon fiber. In various embodiments, the ram 208 is sealably disposed in launch vessel 202. The ram 208 optionally includes a plurality of protrusions 210 to maintain a projectile, such as a UAV, in alignment with the ram 208 while the ram 208 traverses the length of the launch vessel 202.

Figure 3B:
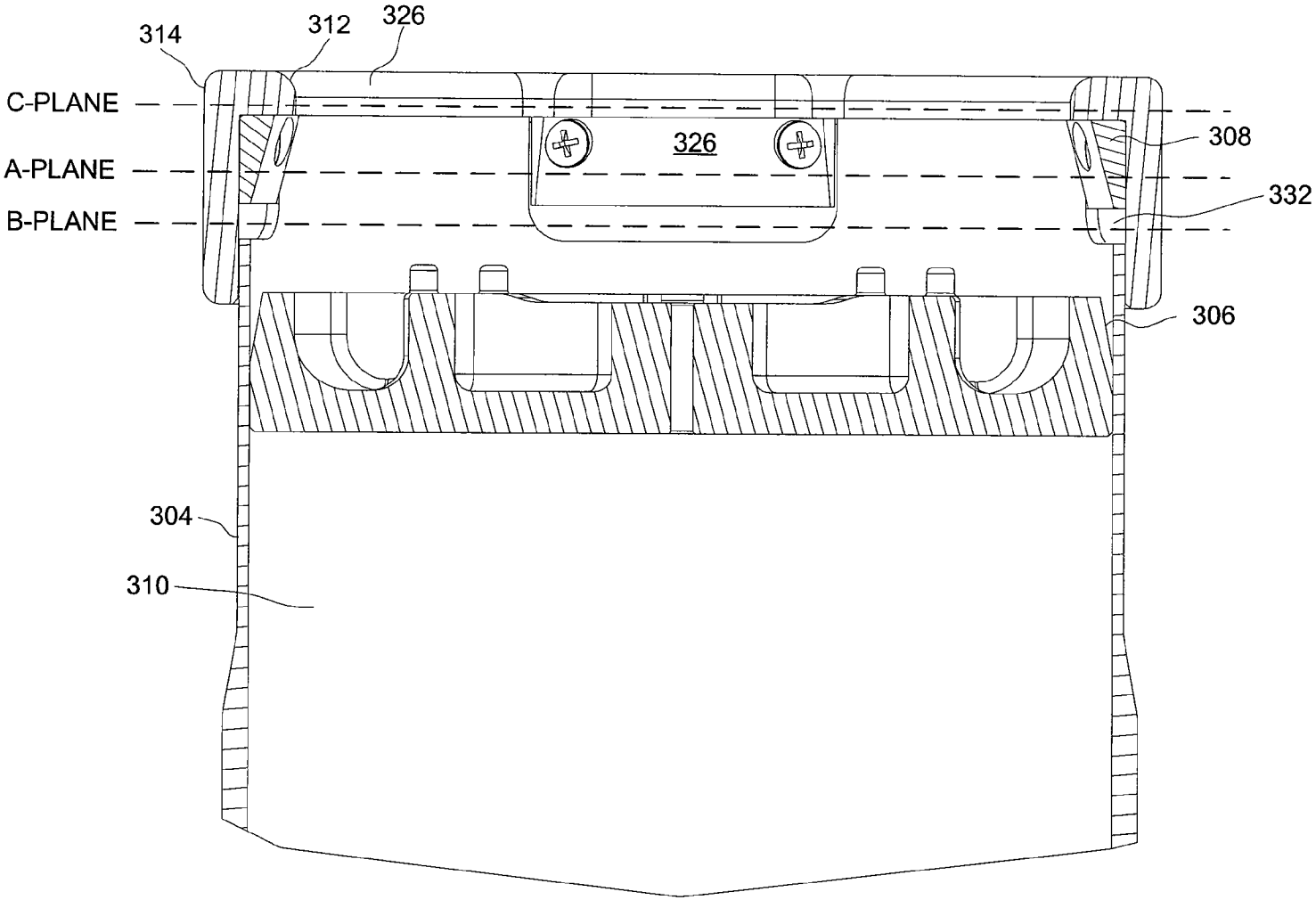
FIG. 3B is a cross section taken along line 3B-3B of FIG. 3A.

In one option, the ram 208 at least partially defines an aperture 212. In various embodiments, a cable is disposed through the aperture 212. In some embodiments, the cable is coupled to a UAV and to electronics disposed outside the launch vessel 202. An example with a cable 302 is illustrated in FIG. 3D.

Some embodiments include four wedges 206 (206 is typical) coupled to the exit opening 214 along an interior of the vessel 202. In various embodiments, the four wedges 206 are located a distance along the length to maintain slack in the cable from the ram 208 to the closed bottom portion 216 after the ram 208 is wedged between at least two of the wedges 206. In some examples, the ram 208 is percussion welded to the wedges 206. In various embodiments, the wedges 206 have a slow such that the ram material percussion welds to the ring when propelled by the charge. In some embodiments, the launch system 200 is configured to allow a user to replace the ram 208 and the wedges 206 after each launch.

In various embodiments, the launch system 200 includes at least one lip 218 extending into the interior of the launch vessel 202. In various embodiments, the lip 218 is further away from the closed bottom portion 216 than are one or more of the four wedges 206. In some embodiments, electronics are coupled to the connector 220 to detonate a charge disposed in the bottom portion 216 to propel the ram 208.

FIG. 3A is a perspective view of an exit opening, according to some embodiments. FIG. 3B is a cross section taken along line 3B-3B of FIG. 3A. A ram 306 is disposed in a launch vessel 304. In a first mode of operation, the ram 306 is freely slidable in the launch vessel 304. In the first mode of operation, across a cross section taken along B-PLANE, a clearance fit between the ram 306 and the launch vessel 304 is present. The interior 310 has an interior boundary in the cross section B-PLANE.

Figure 3C:
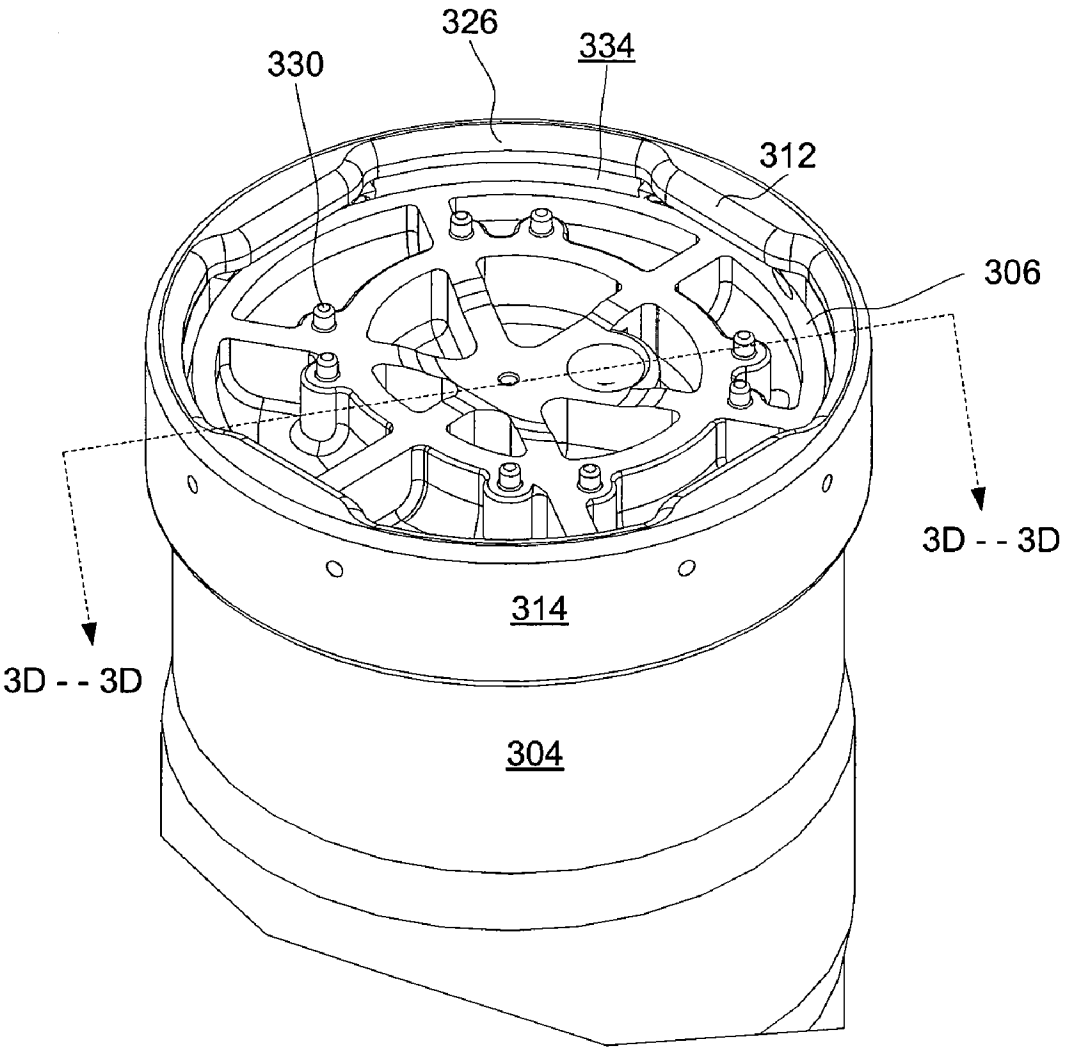
FIG. 3C is a perspective view of the exit opening of FIG. 3A in a second mode of operation, according to some embodiments.
Figure 3D:
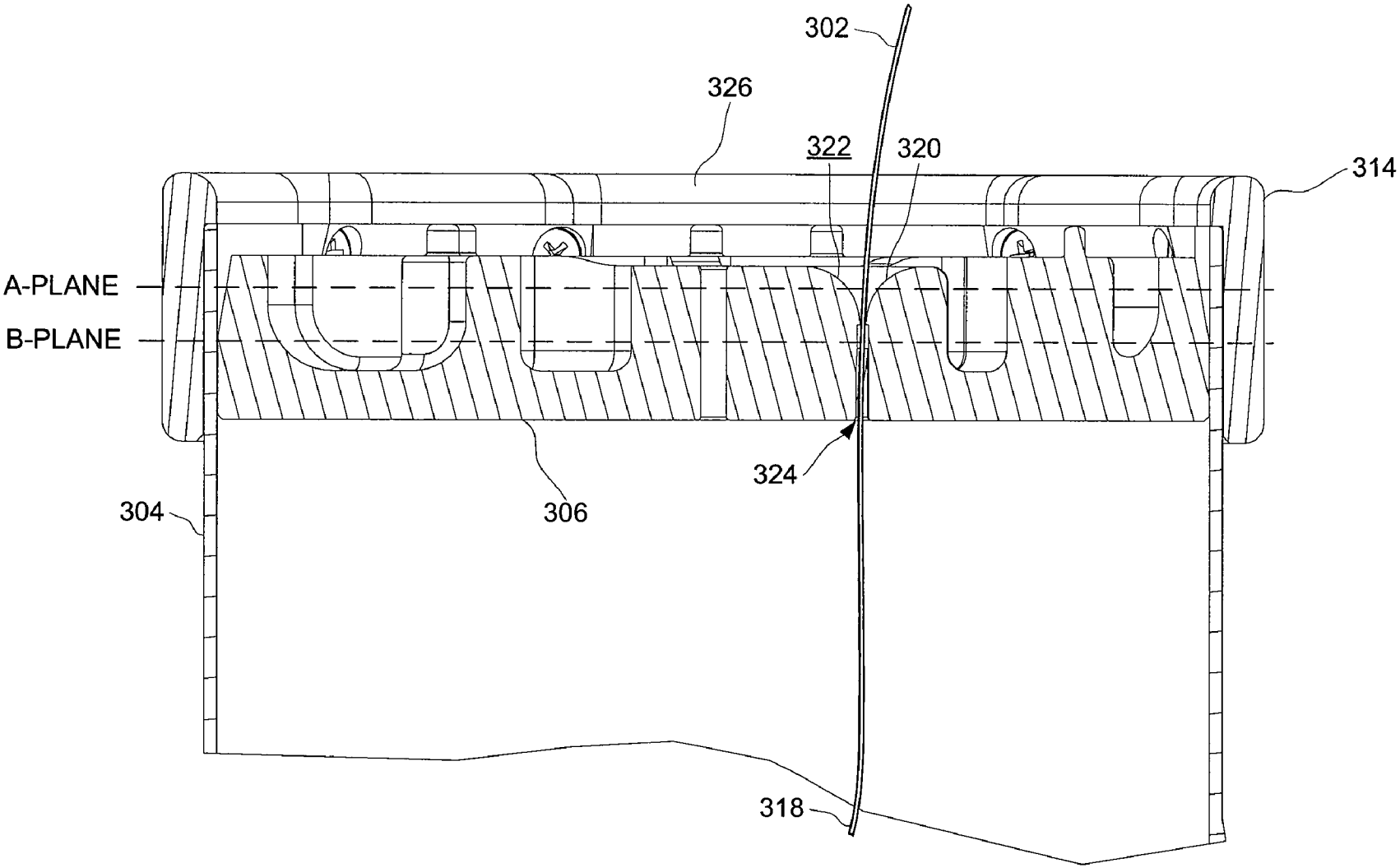
FIG. 3D is a cross section taken along line 3D-3D of FIG. 3C.

FIG. 3C is a perspective view of the exit opening of FIG. 3A in a second mode of operation, according to some embodiments. FIG. 3D is a cross section taken along line 3D-3D of FIG. 3C. In a second mode of operation, the ram 306 is wedged in the vessel 304 between one or more wedges 308 (308 is typical of four wedges in this embodiment). In the second mode of operation, along a cross section taken along A-PLANE, the interior 310 has a reduced interior boundary between the ram 306 and the launch vessel 304. The reduced interior boundary is less than the cross interior boundary in the A-PLANE, in various embodiments. When the ram 306 has a perimeter coplanar to an interior boundary through the one or more wedges 308, such as through the A-PLANE, the ram 306 may be interference fit between one or more wedges 308 along that perimeter. In various embodiments, each of the one or more wedges 308 includes a wedge or ramp surface 328 facing the interior of the barrel, the ramp surface 328 having a slope selected such that the ram 306 is interference fit between ramps after the ram 306 is propelled by a charge to launch the ordinance.

Optionally, one or more lips 312 (312 is typical) define a further interior boundary through the C-PLANE. In various embodiments, the one or more lips 312 are step-shaped, but the present subject matter includes other shapes, such as ramps. The further interior boundary defined by the one or more lips 312 is less than the interior boundaries through both the A-PLANE and the B-PLANE. In some embodiments, the materials of the ram 306 and wedges 308 are selected so that one or both of the ram 306 and one or more wedges 308 can deform, either plastically or elastically or both, so that the ram 306 is interference fit between the wedges 308. In various embodiments, the interior boundary through the C-PLANE is sized so that the ram 306 cannot pass through that interior boundary. In various embodiments, the lip 312 is a feature of a collar 314. In various embodiments, the collar 314 is coupled to the launch vessel 304. The collar 314 can be coupled to the launch vessel 304 via adhesive, fasteners or another coupling. In various embodiments, the one or more wedges 308 are coupled to one or both of the collar 314 and the launch vessel 304.

In some embodiments, there are four lips 312. In various embodiments, each has a length S. In some embodiments, the length S is approximately 15 degrees, but the present subject matter is not so limited. In additional embodiments, the lips 312 have different arc lengths. In various embodiments, each of the lips 312 has a length S that spans the same length of a corresponding one or more wedges 308. In some embodiments, S is around 90 degrees. In some of these embodiments, three or fewer wedges 308 are used. In some embodiments, a wedge 308 encircles the entire exit opening 326. In some embodiments, a single lip 312 encircles most of or the entire exit opening 326.

In some embodiments, each lips 312 has an arc length equal to its corresponding one or more wedges 308 and abuts the corresponding one or more wedges 308. In these embodiments, the lip 312 assists in stopping the ram 306 from exiting the launch vessel 304 in addition to resisting movement of the one or more wedges 308 outside of the launch vessel 304, should the fasteners 316 (316 is typical) shear. The lip 312 is part of four step shape stops, each abutting a respective wedge 308, each spanning an arc of the circumference approximately equal to a further arc spanned by a respective wedge 308.

In various embodiments, a projectile is coupled to the barrel with a cable 302 disposed through the ram 306. In various embodiments, the cable 302 is coupled to the bottom portion of the launch vessel 304. In various embodiments, the cable 302 is sized such that when the ram 306 is wedged between at least two of the one or more wedges 308, the cable 302 has slack 318 between the ram 306 and the bottom portion of the launch vessel 304. In various embodiments, a projectile is coupled to the ram 306 using protrusions 330 (330 is typical) to align the projectile to the ram 306.

In various embodiments, the cable 302 is disposed through an aperture 320. In various embodiments, the aperture 320 has a top portion that is funnel-shaped. In some embodiments, the interior face 322 of the funnel is linear. In additional embodiments, it is parabolic. In some embodiments, a bottom portion 324 of the aperture 320 is linear. In additional embodiments, it is non-linear. Accordingly, in some embodiments, the aperture 320 is hour-glass shaped. In some embodiments, the shape of the funnel is selected so that the cable 302 is subjected to maximum bend radius proximal the ram 306. In various embodiments, the bend radius is specified to allow the cable 302 to elastically bend. In some embodiments, the aperture 320 is filled with a potting material, such as an adhesive.

In various embodiments, a recess 332 is defined in the launch vessel 304. In various embodiments, the recess 332 is deep enough so a portion of the one or more wedges 308 can fit into it. In various embodiments, the recess 332 is deep enough so there is a smooth transition from an inside face 334 of the launch vessel 304 to a ramp surface 328. The ramp surface 328 faces the interior 310. In some embodiments, the one or more wedges 308 do not fully fill the recess 332, leaving a space 336. In other embodiments, the one or more wedges 308 fill the recess 332.

Figure 4:
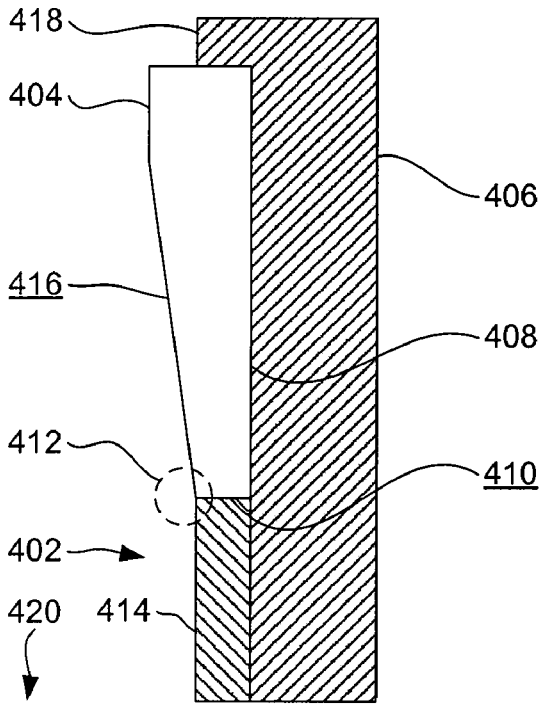
FIG. 4 is a partial cross section of a stepless wedge, according to various embodiments.

FIG. 4 is a cross section of a stepless wedge, according to various embodiments. In various embodiments, a collar 406 and a vessel 414 define one or more interior recesses 408, with one or more respective wedges 404 disposed in the respective recesses 408. In various embodiments, a wedge 404 is shaped to fit in and conform to a defined interior recess 408. In various embodiments, a wedge 404 is coupled to one or more of a vessel 414 and a collar 406. In various embodiments, the wedge 404, collar 406 and vessel 414 define a stepless transition 412 from the interior 402 of the vessel 414 to a wedge surface 416 of the wedge 404. In various embodiments, the wedge 404 is shaped such that the wedge surface 416 is uniformly distant from the vessel 414 around a circumference of the vessel 414. In some embodiments, each wedge 404 includes an edge 410 facing the bottom portion 420 of the vessel 414. In various embodiments, the edge 410 abuts the vessel 414.

Figure 5:
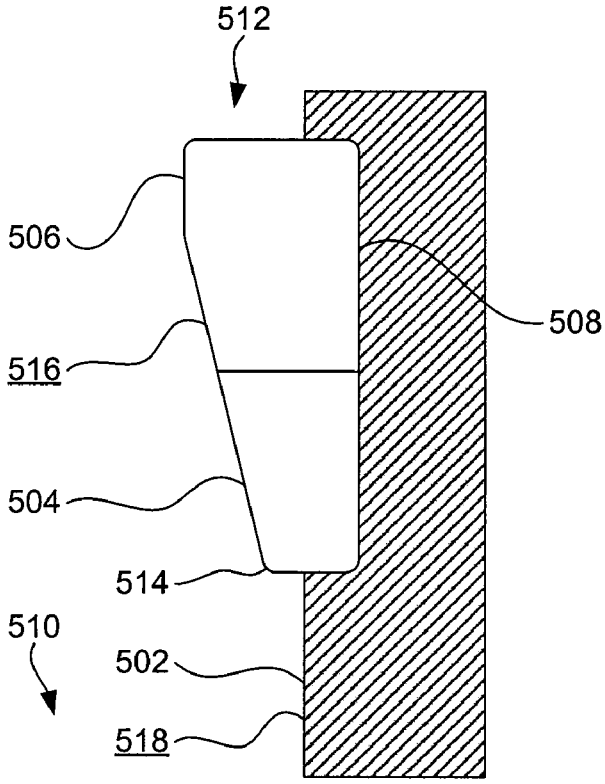
FIG. 5 is a partial cross section of a launch system interior including a recess for a wedge, according to some embodiments.

FIG. 5 is a cross section of a launch system interior including a recess 508 for a wedge, according to some embodiments. In various embodiments, each of one or more wedges includes a first portion 504 toward the bottom portion 510 of a launch vessel 502. A second portion 506 is positioned toward an exit opening 512. In various embodiments, the first portion 504 and the second portion 506 comprise different materials. In some embodiments, the first portion 504 is comprised of nylon. In additional embodiments, the second portion 506 is comprised of carbon fiber. The first 504 and second 506 portions define a wedge surface 516 that is planar. The first 504 and second 506 portions extend beyond an interior surface 518, and therefore the configuration defines a step. In various embodiments, a wedge edge 514 that faces the bottom portion 510 of the launch vessel 502 is rounded.

In the present description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A launch system for launching a projectile, comprising:

a propellant disposed inside a barrel, the propellant coupled between a closed bottom portion of the barrel and a ram sealably disposed in the barrel, the propellant to force the ram toward an exit opening of the barrel, the ram to carry the projectile in alignment with the barrel along a length of the barrel and out the exit opening; and one or more ramps coupled to the barrel inside the barrel, the ramps disposed around the exit opening, the ramps to wedge the ram and stop the ram as the ram travels toward the exit opening, wherein the projectile is coupled to the barrel with an electronics cable configured to couple with electronics and control the projectile, the electronics cable disposed through the ram, and the one or more ramps are located a distance along the length, away from the bottom portion, to maintain slack in the cable between the ram and the closed bottom portion when the ram is wedged between at least two of the one or more ramps.

2. The system of claim 1, wherein the one or more ramps conform to an interior of the barrel, the ramps being curved shaped such that a ramp surface is uniformly distant from the barrel around a circumference of the barrel.

3. The system of claim 1, wherein a bottom-facing edge of at least one of the one or more ramps is shaped to define a stepless transition from a non-ramp portion of an interior of the barrel to a surface of the one or more ramps that is exposed to the interior of the barrel.

4. The system of claim 3, wherein at least one of the one or more ramps is disposed in a recess of the barrel.

5. The system of claim 1, wherein each ramp includes a ramp surface facing an interior of the barrel, the ramp surface having a slope selected such that the ram is interference fit between ramps after the ram is propelled by a charge to launch the projectile.

6. A lightweight launch system for launching an unmanned aerial vehicle ("UAV"), the launch system comprising:

a carbon fiber cylinder of a length extending from a distal portion terminating at an exit opening to a proximal portion terminating at a closed bottom portion;

a carbon fiber ram sealably disposed in the carbon fiber cylinder, the ram including a plurality of protrusions to maintain the UAV in alignment with the ram while the ram traverses the length of the cylinder, the ram at least partially defining an aperture;

a electronics cable disposed through the aperture and coupled to the UAV and to electronics disposed outside the cylinder;

a propellant disposed in the cylinder between the closed bottom portion and the ram, the propellant to force the ram and the UAV out of the cylinder;

four wedges coupled to the exit opening along an interior of the cylinder, the four wedges to define a modified interior of the cylinder at the exit opening that has a reduced interior boundary that is less than a cross section at the closed bottom portion, the four wedges located a distance along the length to maintain slack in the cable from the ram to the closed bottom portion after the ram is wedged between at least two of the wedges; and at least one step-shaped stop extending into the interior of the cylinder, the step-shaped stop further away from the closed bottom portion than the four wedges, the step-shaped stop defining a further modified interior that has a further reduced interior boundary that is less than the cross section, wherein the system is formed of components of a mass less than a specified mass for carry by a single soldier.

7. The system of claim 6, wherein the propellant includes a gas generator.

8. The system of claim 6, wherein the aperture has an hour-glass shape when cross sectioned along the length of the cylinder.

9. The system of claim 8, wherein the step-shaped stop is part of a collar that extends around the exit opening.

10. The system of claim 9, wherein the at least one step-shaped stop is part of four step-shaped stops, each abutting a respective wedge, each spanning an arc of a circumference approximately equal to a further arc spanned by a respective wedge.

* * * * *